US006575050B1

(12) United States Patent
Greene

(10) Patent No.: US 6,575,050 B1
(45) Date of Patent: Jun. 10, 2003

(54) SINGLE STICK CONTROL FOR BACKHOE

(76) Inventor: Geoffrey B. Greene, 2724 Van Der Veer Dr., Memphis, TN (US) 38133-4903

( * ) Notice: Subject to any disclaimer, the term of this patent is extended or adjusted under 35 U.S.C. 154(b) by 16 days.

(21) Appl. No.: 09/707,601

(22) Filed: Nov. 7, 2000

(51) Int. Cl.[7] ..... G05G 11/00

(52) U.S. Cl. ..... 74/490.14; 74/491; 137/636

(58) Field of Search ..... 74/471 XY, 490.14, 74/491; 137/636, 636.2

(56) References Cited

U.S. PATENT DOCUMENTS 5,112,184 A * 5/1992 Tapper et al. ..... 137/636.2
5,316,435 A * 5/1994 Mozingo ..... 414/685

* cited by examiner

*Primary Examiner*—Allan D. Herrmann

(57) ABSTRACT

A control device for a backhoe that moves four separate reversible hydraulic valves in any combination or all at the same time with only one human hand needed to manipulate said controls. These valves are controlled through an organized series of arms, levers, and push rods. Lever one 1 can pivot forward or backward, move up or down, push forward or pull backward, and move to the left or right. Lever two 2 pivots up or down at lever four 4, therefore lever one 1 moves with lever two 2 as a unit. Lever four 4 spins around lever three 3 with lever two 2 and lever one 1 as a unit. Lever three 3 pivots forward and backward taking lever four 4, lever two 2, and lever one 1 with it as a unit. Lever one 1 pivots forward or backward to actuate valve 20 through a number of pins, rods, and arms. As lever one 1 is moved up or down, it pivots lever two 2 causing valve 22 to be actuated, leaving valve 20 uninterrupted. As lever one 1 is pushed forward or backward it does cause lever four 4 to pivot forward or backward actuating valve 24, however, this does not cause lever two 2 to move up or down or lever one 1 to pivot forward or backward therefore keeping their respective valves from inadvertently actuating. As lever one 1 is moved to the left or right it spins lever two 2 and lever four 4 around lever three 3 causing bent arm 12 to actuate valve 26 without affecting the other valves.

6 Claims, 1 Drawing Sheet

SINGLE STICK CONTROL FOR BACKHOE

CROSS-REFERENCE TO RELATED APPLICATION

Figure 1:
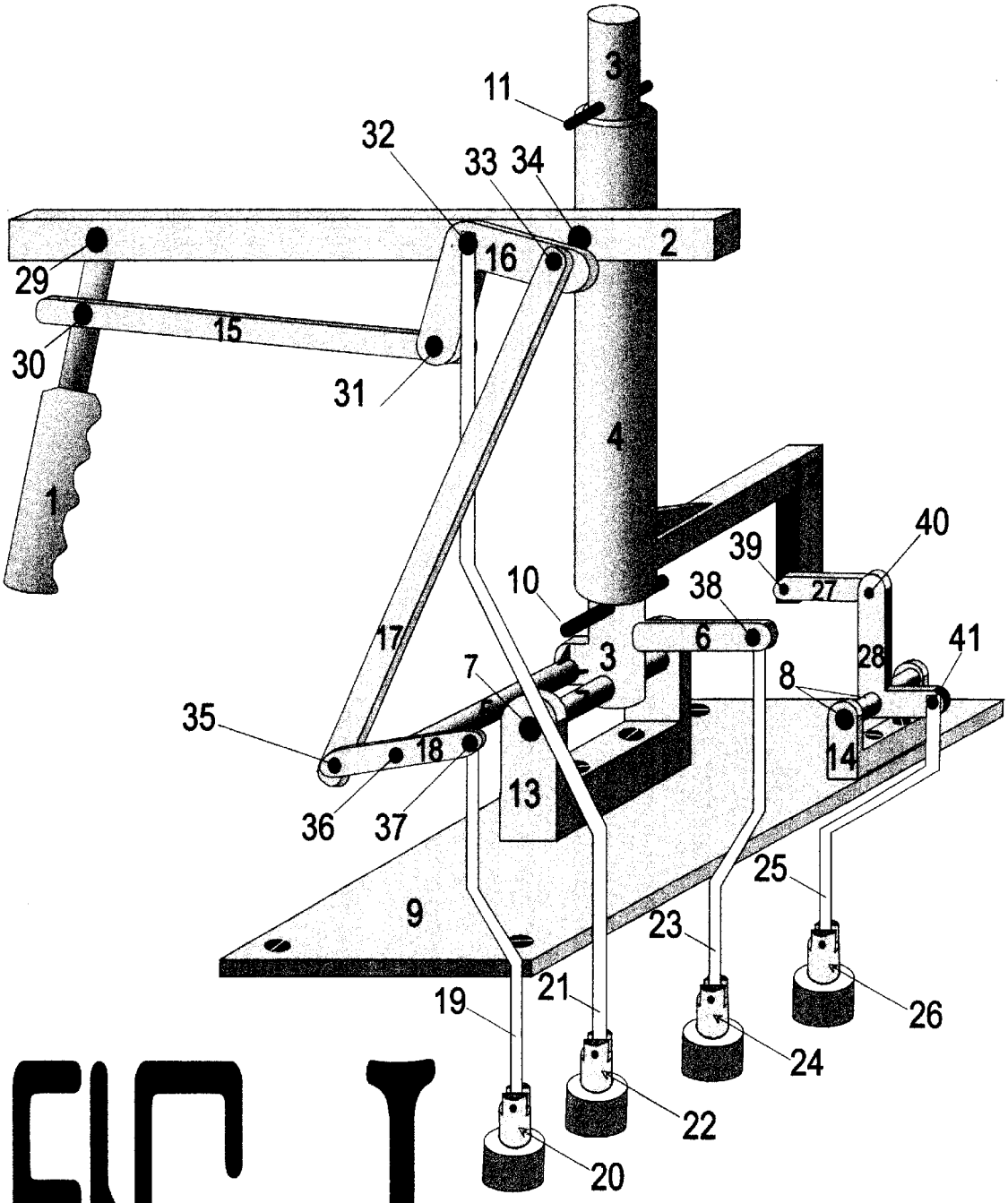

Not applicable.

BACKGROUND-FIELD OF INVENTION

This invention relates to backhoes, specifically to an improved mechanism for controlling backhoes.

BACKGROUND-DESCRIPTION OF PRIOR ART

Originally a backhoe was controlled with four sticks, each stick moving forward or backward controlling only one valve. The movement of the sticks did not always correspond to the movements of the arm.

The prior art's swing control stick moves forward or backward in a counterintuitive manner since the actual boom assembly swings left or right. The prior art's main boom control stick moves forward or backward in a counterintuitive manner since the actual boom pivots up or down. The prior art's crowd boom control stick moves forward or backward as the actual crowd boom does indeed move forward or backward. Pushing or pulling the bucket control stick does make the bucket curl or uncurl.

With all of this in mind, it should be obvious to anyone that these controls make it difficult to maintain a useful speed, since in a normal digging operation it usually requires over 90 valve movements per minute.

A second-generation control incorporated a foot pedal for the swing control valve and kept three separate sticks for the other control valves. The said foot pedal improved matters greatly with the left foot intuitively swinging the boom assembly to the left and the right foot intuitively swinging the boom assembly to the right. The second-generation's main boom control stick still moves forward or backward in a counterintuitive manner from the actual boom that pivots up or down. The second-generation controls were still difficult to use and took an inordinate amount of time to master.

A third-generation control uses two sticks in which each stick moves to the left or right controlling one valve and forward or backward controlling a second valve. This was a wonderful improvement, however; moving the right stick to the left or right is not intuitive when filling or emptying a bucket curling towards or away from you. Pushing or pulling a stick does not easily relate to a boom going up or down. My invention addresses these problems by letting an operator's single hand, moving up or down, left or right and rolling forward or backward control the entire boom assembly.

SUMMARY

In accordance with the present invention a devise that controls a backhoe in which a single control stick moves in four distinct reversible directions and said backhoe mimics the four said movements.

Objects and Advantages

Accordingly, besides the objects and advantages of the single control stick described in my patent above several objects and advantages of the present invention are:

(a) to provide a product that will pay for itself.

(b) to provide a product safer to operate than prior art for beginners and experts alike.

(c) to provide a product that works in a more time efficient manner.

(d) to provide a product much easier to use than prior art.

(e) to provide a product that is easy to produce.

(f) to provide a product that will hold up to the workload placed upon it.

(g) to provide a product easily repairable.

(h) to provide a product no-one else offers.

(i) to provide a product to take the frustration out of operating a backhoe and making it an enjoyable experience.

(j) to provide a product as close to 100% reliable as mechanically possible.

(k) to provide a product that substantially reduces fuel consumption, air pollution, and noise pollution.

(l) to provide a product that is desirable and most people can afford.

(m) to provide a product that looks mechanically sound, as it actually is.

(n) to provide a product with superior quality.

(o) to provide a product that makes the user happy.

(p) to provide a product that is compatible with all existing backhoe models.

(q) to provide a product that fits into many distribution channels currently established.

(r) to provide a product that needs little or no service.

Further objectives and advantages of my invention will become apparent from a consideration of the drawings and ensuing description.

DRAWING FIGURES

FIG. 1 is a complete perspective view of my invention in detail.

REFERENCE NUMERALS IN DRAWINGS

1 LEVER ONE held by fulcrum 29 that is mounted in lever two 2 to hold pivot pin 30

2 LEVER TWO held by fulcrum 34 that is mounted in lever four 4 to hold pivot pin 32 and fulcrum 29

3 LEVER THREE to hold parts, 4, 5, 6, 10 and 11 it is held by fulcrum 7 mounted in pillow block 13

4 LEVER FOUR that is supported by and spins around lever three 3 contained by expansion pins 10 and 11 to hold fulcrum 34 and bent extension arm 12

5 EXTENSION ARM welded to lever three 3 to hold pivot pin 36

6 EXTENSION ARM welded to lever three 3 to hold pin 38

7 FULCRUM connecting lever three 3 and pillow block 13 said pivot pin is mounted in lever three 3

8 PIVOT PIN connecting bent aim 28 and pillow block 14 pivot pin is mounted in bent arm 28

9 BASE PLATE to hold pillow blocks 13 and 14

10 EXPANSION PIN held by lever three 3 to contain lever four 4

11 EXPANSION PIN held by lever three bar 3 to contain lever four 4

12 BENT EXTENSION ARM welded to lever four 4 to hold ball joint 39

13 PILLOW BLOCK to hold fulcrum 7

14 PILLOW BLOCK to hold pivot pin 8

15 PUSH ROD held between pivot pins 30 and 31

16 BENT ARM held by pivot pin 32 to hold pivot pins 31 and 33

17 PUSH ROD held between pivot pins 33 and 35
18 ARM held by pivot pin 36 to hold pivot pins 35 and 37
19 PUSH ROD held between pivot pin 37 and existing bucket valve assembly 20
20 EXISTING BUCKET VALVE ASSEMBLY (this is one of the existing valves the invention directly controls)
21 PUSH ROD held between pivot pins 32 and main boom valve assembly 22
22 EXISTING MAIN BOOM VALVE ASSEMBLY (this is one of the existing valves the invention directly controls)
23 PUSH ROD held between pivot pins 38 and existing crowd valve assembly 24
24 EXISTING CROWD BOOM VALVE ASSEMBLY (this is one of the existing valves the invention directly controls)
25 PUSH ROD held between pivot pin 41 and existing swing valve assembly 26
26 EXISTING SWING VALVE ASSEMBLY (this is one of the existing valves the invention directly controls)
27 PUSH ROD held between ball joints 39 and 40
28 BENT ARM held by pivot pin 8 to hold ball joint 40 and pivot pin 41
29 FULCRUM connecting lever two 2 to lever one 1 pivot pin is mounted in lever two 2
30 PIVOT PIN connecting lever one 1 to push rod 15 pivot pin is mounted in lever one 1
31 PIVOT PIN connecting push rod 15 to bent arm 16 pin is mounted in bent arm 16
32 PIVOT PIN connecting lever two 2, bent arm 16 and pushrod 21 pin is mounted in lever two 2
33 PIVOT PIN connecting bent arm 16 to push rod 17 pin is mounted in bent arm 16
34 FULCRUM connecting lever four 4 to lever two 2 pin is mounted in lever four 4 said pin does not touch lever three 3
35 PIVOT PIN connecting push rod 17 to arm 18 pin is mounted in arm 18
36 PIVOT PIN connecting extension arm 5 to arm 18 pin is mounted in extension arm 5
37 PIVOT PIN connecting arm 18 to push rod 19 pin is mounted in arm 18
38 PIVOT PIN connecting extension arm 6 to push rod 23 pin is mounted in extension arm 6
39 BALL JOINT connecting bent extension arm 12 to push rod 27
40 BALL JOINT connecting push rod 27 to bent arm 28
41 PIVOT PIN connecting bent arm 28 to push rod 25 pin is mounted in bent arm 28

DESCRIPTION AND OPERATION OF INVENTION

FIG. 1 shows a perspective view of a basic version of my invention. There is a main base plate 9 screwed to a frame of a backhoe. The invention incorporates a multitude of levers, pins, fulcrums, rods, and handles on levers. These pieces join together to form an organized method of controlling four separate reversible existing hydraulic valve assemblies in any combination or all at the same time with only one human hand needed manipulate said device. Lever one 1 can be manipulated by a human hand in four different reversible motions. The motions that can be achieved are first pivoting forward or backward, second moving up or down, third pushing forward or pulling backward, and fourth, moving to the left or right The description of said invention starts in the upper left hand corner with said lever one 1. This said lever one 1 has five logical paths leading to it and a number of subsets of parts acting together to actuate a group of four existing control valve assemblies. One of the paths holds lever one 1 up. The other four paths lead to four different existing control valve assemblies. Each path contains a number of parts that act as a unit. They are as follows:

A lever two 2 pivots up or down at a lever four 4, therefore lever one 1 moves with lever two 2 as a unit. Lever four 4 spins around a lever three 3 with lever two 2 and lever one 1 as a unit. Lever three 3 pivots forward or backward taking Lever four 4, lever two 2, and lever one 1 with it as a unit. Lever one 1 pivots forward or backward to actuate valve 20 through a number of pins, rods, and arms. As lever one 1 is moved up or down, it pivots lever two 2 causing valve 22 to be actuated, leaving existing valve assembly 20 uninterrupted. As lever one 1 is pushed forward or backward it does cause lever four 4 to pivot forward or backward actuating valve 24; however, this does not cause lever two 2 to move up or down or lever one 1 to pivot forward or backward therefore keeping their respective valves from inadvertently actuating. As lever one 1 is moved to the left or right it spins lever two 2 and lever four 4 around lever three 3 causing a bent extension arm 12 to actuate valve 26 without affecting the other existing valve assemblies.

The first path is the path that holds the handle in place and the next four paths each transfer one of the said motions from lever one 1 to the respective existing control valve assemblies.

Lever one 1 is supported by lever two 2. Lever two 2 is supported by lever four 4. Lever four 4 is supported by lever three 3. Lever three 3 is supported by a pillow block 13. Pillow block 13 attaches directly to the base plate 9.

The second path to explain would be the control path to the existing bucket control valve assembly 20. It starts with said lever one 1, which pivots forward or backward on pivot pin 29 relative to lever two 2, controlling a pivot pin 30. Pivot pin 30 in turn controls a push rod 15 that rotates a bent arm 16. Bent arm 16 controls a push rod 17 in turn rotates an arm 18. Arm 18 controls a push rod 19 that actuates existing bucket valve assembly 20.

The third path to explain would be the control path to existing main boom control valve assembly 22. It starts with said lever one 1 that will move up or down pivoting causing lever two 2 to pivot on a pivot pin 34. Lever two 2 moves a pivot pin 32 up or down controlling push rod 21 which actuates existing main boom valve assembly 22.

The fourth path to explain would be the control path to existing crowd boom control valve assembly 24. It starts with the lever one 1 that can move forward or backward causing lever two 2 to pivot lever four 4 around a pivot pin 7. Lever four 4 takes lever three 3 with it so that lever three 3 rotates around pivot pin 7 as lever three 3 takes arm 6 and pivot pin 38 up or down around pivot pin 7. Arm 6 controls a pushrod 23. Which actuates the existing crowd boom valve assembly.

The fifth path to follow would be the control path to the existing swing control valve assembly 26. It starts with lever one 1 that can move to the left or to the right causing lever two 2 and lever four 4 to spin around lever three 3. When lever four 4 spins it also rotates bent extension arm 12 forward or backward causing a pushrod 27 to go with bent extension arm 12. Push rod 27 causes a bent arm 28 to rotate around pivot pin 8. Bent arm 28 causes push rod 25 to move up or down in turn actuating the existing swing control valve assembly 26.

CONCLUSIONS, RAMIFICATIONS, AND SCOPE

Accordingly, the reader will see that an inexperienced operator will become familiar, therefore, productive with these controls in a very short period of time. A new operator will have instinctive reactions when controlling a backhoe instead of spending six months to learn appropriate reactions as with the prior art. This invention permits the operation of a backhoe with one hand, leaving the other hand free. It permits the operator to use both hands, if desired.

Although the description above contains many specifics, these should not be construed as limiting the scope of this invention but merely as providing an illustration of one embodiment. Many other variations are possible.

Thus, the scope of this invention should be determined by the appended claims and their legal equivalents rather than the examples given.

SEQUENCE LISTING

Not applicable.

I claim:

1. A control device for a machine comprising:

a series of four levers with a means for a single human hand to adjust the position of four separate hydraulic valves independently and in any combination, all at the same time, werein said first lever's fulcurm is mounted on said secound lever's handle enabling said first lever's fulcurm to operate said secound lever.

2. The control device, as set forth in claim 1, wherein said second lever's fulcrum is mounted on said third lever's handle so that said first lever's fulcrum can operate said third lever by pushing said second lever to and fro with said first lever's fulcrum all on the same plane.

3. The control device, as set forth in claim 2, wherein said first lever's fulcrum can also use said second lever in a second plate to torque said third lever, which acts as a said fourth lever on said third plane.

4. The control device, as set forth in claim 3, wherein said third lever's fulcrum is attached to a base plate and said fourth lever's fulcrum is said third lever's cross-section.

5. The control device, as set forth in claim 4, wherein each of the said four levers controls a separate hydraulic valve.

6. The control device, as set forth in claim 5, wherein said single human hand holding said first lever can adjust the position of all four said hydraulic valves independently and in any combination, all at the same time.

* * * * *